US009955808B2

(12) United States Patent
Jin

(10) Patent No.: US 9,955,808 B2
(45) Date of Patent: May 1, 2018

(54) SIDE PUSH BUTTON LID

(71) Applicant: Zhejiang Yongheng Household Co., Ltd., Zhejiang (CN)

(72) Inventor: Zhaoping Jin, Zhejiang (CN)

(73) Assignee: Zhejiang Yongheng Household Co., Ltd., Zhejiang (CN)

( * ) Notice: Subject to any disclaimer, the term of this patent is extended or adjusted under 35 U.S.C. 154(b) by 308 days.

(21) Appl. No.: 14/866,479

(22) Filed: Sep. 25, 2015

(65) Prior Publication Data

US 2016/0114944 A1 Apr. 28, 2016

(30) Foreign Application Priority Data

Oct. 22, 2014 (CN) ..... 2014 2 0614214 U

(51) Int. Cl.

| | |
|---|---|
| ***B65D 47/28*** | (2006.01) |
| ***A47G 19/22*** | (2006.01) |
| ***B65D 47/20*** | (2006.01) |
| *B65D 47/26* | (2006.01) |

(52) U.S. Cl.

CPC ..... *A47G 19/2272* (2013.01); *B65D 47/2093* (2013.01)

(58) Field of Classification Search

CPC ..... A47G 19/2272; B65D 47/2093
USPC ..... 220/254.5, 719, 715, 714
See application file for complete search history.

(56) References Cited

U.S. PATENT DOCUMENTS

| | | | | |
|---|---|---|---|---|
| 3,967,748 A * | 7/1976 | Albert | A47G 19/2272 | 215/307 |
| 4,094,433 A * | 6/1978 | Numbers | A47G 19/2272 | 220/254.5 |
| 4,099,642 A * | 7/1978 | Nergard | A47G 19/2272 | 220/254.5 |
| 4,212,408 A * | 7/1980 | Valenzona | A47G 19/2272 | 220/254.5 |
| 5,427,271 A * | 6/1995 | Wang | A47G 19/2272 | 220/255 |
| 6,098,834 A * | 8/2000 | Hatsumoto | A47G 19/2272 | 220/212.5 |
| 8,397,940 B2 * | 3/2013 | Steininger | A45F 3/18 | 220/254.1 |
| 8,464,895 B2 * | 6/2013 | Gilbert | A47G 19/2272 | 215/307 |
| 8,844,762 B2 * | 9/2014 | Chiou | B65D 43/02 | 215/305 |

(Continued)

*Primary Examiner* — J. Gregory Pickett
*Assistant Examiner* — Niki M Eloshway
(74) *Attorney, Agent, or Firm* — Schmeiser, Olsen & Watts, LLP

(57) ABSTRACT

The utility model belongs to cups, particularly a new side push button lid. The cup lid comprises a threaded body, a hold-down piece, a sealing seat, an upper lid body, an upper lid plate, a push rod, a sealing valve, and a button connected successively from bottom up. The middle area of the lower end of the push rod is movably connected with the holder on the hold-down piece; one end of the push rod is connected with a sealing valve in a snap-fit manner; the other end is connected with a drive rod of the button; and the upper end of the seal valve abuts the water outlet of the upper lid plate. The pressed button drives the drive rod to apply a pushing force to the push rod to force the sealing valve to move downward, the sealing valve is removed from the water outlet and water is supplied.

4 Claims, 1 Drawing Sheet

(56) References Cited

U.S. PATENT DOCUMENTS

| | | | | |
|---|---|---|---|---|
| 8,960,490 | B2 * | 2/2015 | Carlile | B65D 47/249 220/254.5 |
| 2002/0092851 | A1 * | 7/2002 | Belcastro | A47G 19/2272 220/254.4 |
| 2015/0150395 | A1 * | 6/2015 | George | A47G 19/2272 220/254.5 |
| 2015/0201776 | A1 * | 7/2015 | Elsaden | A47G 19/2272 220/715 |
| 2016/0106241 | A1 * | 4/2016 | Wong | B65D 47/32 220/254.5 |
| 2016/0183703 | A1 * | 6/2016 | Huang | A47G 19/2272 222/173 |
| 2017/0238744 | A1 * | 8/2017 | Sweeney | A47G 23/16 |

* cited by examiner

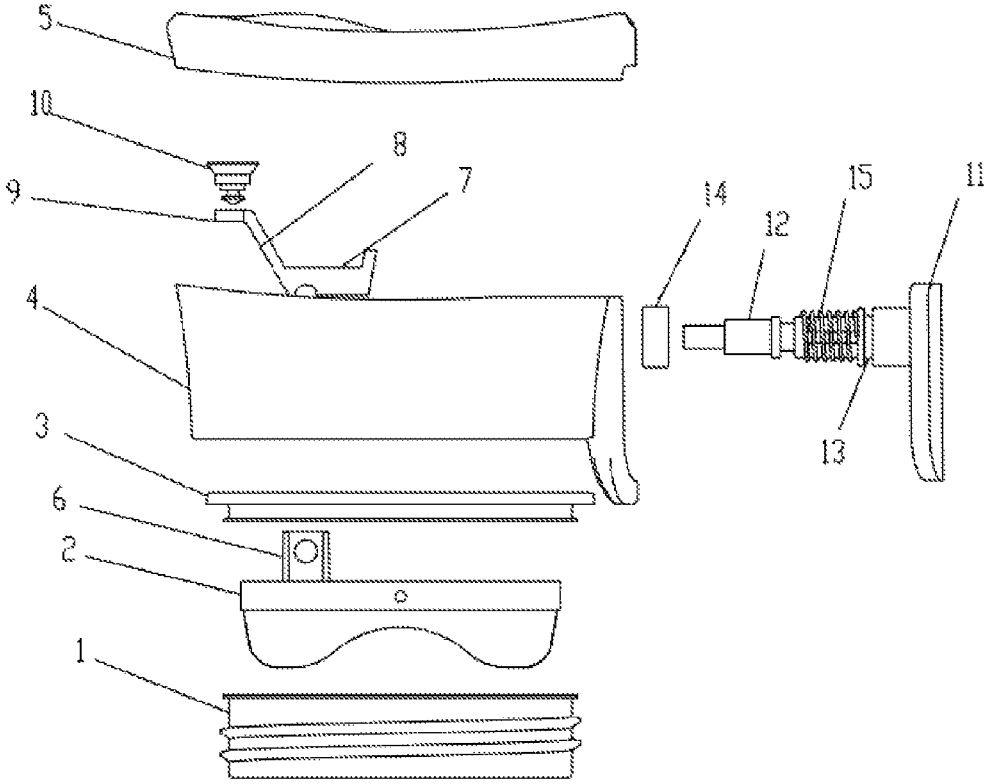
5
10
8
9
7
14
15
11
12
4
3
13
6
2
1

SIDE PUSH BUTTON LID

FIELD OF THE INVENTION

The utility model belongs to the field of cups, and particularly relates to a cup lid.

BACKGROUND OF THE INVENTION

Now for most cups available on the market, a user has to unscrew the cup lid to drink the beverage in a cup, which is very inconvenient in use. Especially, drivers have to do so while driving, thus bringing serious potential safety hazards.

SUMMARY OF THE UTILITY MODEL

The objective of the utility model is to provide a new side push button lid against the inconvenience of drinking of the existing cup.

The utility model is achieved by the following technical solution:

The utility model provides a new side push button lid, including a threaded body, a hold-down piece, a sealing seat, an upper lid body, and an upper lid plate which are connected successively from bottom to top, wherein the upper lid plate is provided with a water outlet; the threaded body is provided with a thread matched with that on a cup body; the upper lid plate is fixedly connected with the upper lid body; the upper end of the hold-down piece is provided with a holder; a push rod is also included; the middle area of the lower end of the push rod is movably connected with the holder on the hold-down piece; one end of the push rod is connected with a sealing valve mounting plate integrally through a supporter; a seal valve is mounted on the sealing valve mounting plate; the upper end of the seal valve abuts against the water outlet of the upper lid plate; a button is connected at the other end of the push rod; a drive rod is connected integrally on the button; one end of the drive rod is connected with the push rod; the side face of the upper lid body is provided with a button mounting hole; the drive rod is embedded movably into the button mounting hole of the side wall of the upper lid body; the drive rod is divided into a front section and a rear section by a step; the rear section is provided with a first ring groove; a sealing ring is connected in a snap-fit manner in the first ring groove; a spring is sleeved on the front section of the drive rod; the outside of the button mounting hole is provided with a counter bore; one end of the spring abuts against the step face of the counter bore; and the other end thereof abuts against the step surface whereby the drive rod is divided into a front section and a rear section.

The sealing valve mounting plate of the push rod is provided with a through hole; the lower end of the sealing valve is provided with a second ring groove; and the lower end of the sealing valve is connected in a snap-fit manner in the through hole of the sealing valve mounting plate.

The lower end part of the sealing valve is of a conical structure.

The sealing valve is made of rubber material.

The utility model has the beneficial effects that when the cup lid provided by the utility model is used, the user only has to press the button to remove the sealing valve to drink and the operation is so simple that the user can drink just with one hand.

BRIEF DESCRIPTION OF THE DRAWINGS

FIG. 1 is an exploded structural schematic diagram of the utility model.

DETAILED DESCRIPTION OF THE EMBODIMENTS

The utility model is described below in detail in conjunction with an embodiment.

Embodiment

It is noteworthy that the novel side-button cup lid shown in FIG. 1 includes a threaded body 1, a hold-down piece 2, a sealing seat 3, an upper lid body 4, and an upper lid plate 5 which are connected successively from bottom to top, wherein the upper lid plate 5 is provided with a water outlet; the threaded body 1 is provided with a thread matched with that on a cup body; the upper lid plate 5 is fixedly connected with the upper lid body 4; the upper end of the hold-down piece 2 is provided with a holder 6; a push rod 7 is also included; the middle area of the lower end of the push rod 7 is movably connected with the holder 6 on the hold-down piece 2; one end of the push rod 7 is connected with a sealing valve mounting plate 9 integrally through a supporter 8; a seal valve 10 is mounted on the sealing valve mounting plate 9; the upper end of the seal valve 10 abuts against the water outlet of the upper lid plate 5; a button 11 is connected at the other end of the push rod 7; a drive rod 12 is connected integrally on the button 11; one end of the drive rod 12 is connected with the push rod 7; the side face of the upper lid body 4 is provided with a button mounting hole; the drive rod 12 is embedded movably into the button mounting hole of the side wall of the upper lid body 4; the drive rod 12 is divided into a front section and a rear section by a step; the rear section is provided with a first ring groove 13; a sealing ring 14 is connected in a snap-fit manner in the first ring groove 13; a spring 15 is put on the front section of the drive rod 12; the outside of the button mounting hole is provided with a counter bore; one end of the spring 15 abuts against the step face of the counter bore; and the other end thereof abuts against the step face whereby the drive rod is divided into a front section and a rear section.

It is further noteworthy that the sealing valve mounting plate 9 of the push rod is provided with a through hole; the lower end of the sealing valve 10 is provided with a second ring groove; and the lower end of the sealing valve 10 is connected in a snap-fit manner in the through hole of the sealing valve mounting plate. The lower end part of the sealing valve is of a conical structure. In addition, the sealing valve is made of rubber material.

When pressed, the button drives the drive rod to apply a pushing force to the push rod, the push rod is forced to rotate along the holder on the hold-down piece since the lower end of the push rod is movably connected with the hold-down piece, one end of the push rod in contact with the drive rod moves upward, the sealing valve mounting plate on the push rod moves downward, and thus the sealing valve is removed from the water outlet of the upper lid plate to supply water from the water outlet; when the button is released, the spring possesses an outward pushing force to the drive rod to force the drive rod to drive the push rod to apply force toward the side where the button is located, and thus the sealing valve mounting plate on the push rod drives the sealing valve to display an upward pushing force to the water outlet of the upper lid plate, so as to realize the sealing between the sealing valve and the water outlet.

The basic principles, main characteristics and advantages of the utility model are shown and described above. Those skilled in the art should be aware that the utility model is not limited by the embodiment disclosed above; the embodiment described above and what is described in the description are only for illustrating the principles of the utility model; without departing from the spirit and scope of the utility model, any simple change and replacement made by the ordinary skilled in the art are within the scope of protection of the utility model.

The invention claimed is:

1. A new side push button lid, comprising a threaded body, a hold-down piece, a sealing seat, an upper lid body and an upper lid plate which are connected successively from bottom to top, wherein the upper lid plate is provided with a water outlet;

the threaded body is provided with a thread matched with that on a cup body;

the upper lid plate is fixedly connected with the upper lid body;

the upper end of the hold-down piece is provided with a holder;

a push rod is also included; a middle area of a lower end of the push rod is movably connected with the holder on the hold-down piece; one end of the push rod is connected directly to a sealing valve mounting plate integral with a supporter and push rod;

a seal valve is mounted on the sealing valve mounting plate, the seal valve having an upper end which abuts against the water outlet of the upper lid plate;

a button is connected at the other end of the push rod;

a drive rod is connected integrally on the button;

one end of the drive rod is connected with the push rod;

a side face of the upper lid body is provided with a button mounting hole;

the drive rod is embedded movably into the button mounting hole of the side wall of the upper lid body;

the drive rod is divided into a front section and a rear section by a step;

the rear section is provided with a first ring groove;

a sealing ring is connected in a snap-fit manner in the first ring groove;

a spring is sleeved on the front section of the drive rod;

the outside of the button mounting hole is provided with a counter bore; one end of the spring abuts against the step face of the counter bore; and the other end thereof abuts against the step surface whereby the drive rod is divided into a front section and a rear section.

2. The new side push button lid of claim 1, wherein the sealing valve mounting plate of the push rod is provided with a through hole;

the lower end of the sealing valve is provided with a second ring groove; and the lower end of the sealing valve is connected in a snap-fit manner in the through hole of the sealing valve mounting plate.

3. The new side push button lid of claim 2, wherein the lower end part of the sealing valve is of a conical structure.

4. The new side push button lid of claim 3, wherein the sealing valve is made of rubber material.

* * * * *